US011008197B2

(12) United States Patent
Nikander et al.

(10) Patent No.: US 11,008,197 B2
(45) Date of Patent: May 18, 2021

(54) METHOD FOR PERFORMING A MANUAL DRIVE IN AN ELEVATOR AFTER MAINS POWER-OFF

(71) Applicant: KONE Corporation, Helsinki (FI)

(72) Inventors: Juhamatti Nikander, Helsinki (FI); Ari Kattainen, Helsinki (FI); Pasi Raassina, Helsinki (FI)

(73) Assignee: KONE CORPORATION, Helsinki (FI)

( * ) Notice: Subject to any disclaimer, the term of this patent is extended or adjusted under 35 U.S.C. 154(b) by 601 days.

(21) Appl. No.: 15/971,346

(22) Filed: May 4, 2018

(65) Prior Publication Data

US 2018/0334359 A1 Nov. 22, 2018

(30) Foreign Application Priority Data

May 19, 2017 (EP) ..... 17172027

(51) Int. Cl.
*B66B 5/02* (2006.01)
*B66B 1/32* (2006.01)
(Continued)

(52) U.S. Cl.
CPC ..... *B66B 5/028* (2013.01); *B66B 1/308* (2013.01); *B66B 1/32* (2013.01); *B66B 1/3492* (2013.01);
(Continued)

(58) Field of Classification Search
CPC ..... B66B 5/028; B66B 5/0087; B66B 5/027; B66B 5/044; B66B 1/308; B66B 1/32; B66B 1/3492
(Continued)

(56) References Cited

U.S. PATENT DOCUMENTS 4,342,021 A * 7/1982 Schaller ..... B66B 1/3492 340/989
5,979,607 A * 11/1999 Allen ..... B66B 5/024 187/390
(Continued)

FOREIGN PATENT DOCUMENTS

JP 2014-122078 A 7/2014
WO WO 2008/100259 A1 8/2008

OTHER PUBLICATIONS

European Search Report of application 17172027.9, dated Jan. 12, 2018.

*Primary Examiner* — David S Warren
(74) *Attorney, Agent, or Firm* — Birch, Stewart, Kolasch & Birch, LLP

(57) ABSTRACT

In a method for performing a manual drive in an elevator after mains power-off, the frequency converter of the motor is separated from mains, any safety blocking of the brake drive and/or motor drive is disabled, current is supplied from the battery to the brake drive to open the elevator brake and current is supplied from the battery to the drive control to allow regulation of the motor speed via the inverter bridge, the manual drive control observes the motor speed via the speed sensor and starts a speed feedback loop to regulate the motor speed to a manual drive reference value by feeding a three phase-AC current to the motor windings via the semiconductors of the inverter bridge, which manual drive speed reference is lower than the speed reference for normal elevator operation, when the car reaches a floor level the floor level indicator is activated, and the actuator is released whereafter the current supply from the battery to the elevator brake is interrupted and the previous disabled safety blocking of the brake drive and/or motor drive is enabled again.

20 Claims, 1 Drawing Sheet

(51) Int. Cl.
*B66B 5/00* (2006.01)
*B66B 1/30* (2006.01)
*B66B 1/34* (2006.01)
*B66B 5/04* (2006.01)

(52) U.S. Cl.
CPC ..... *B66B 5/0087* (2013.01); *B66B 5/027* (2013.01); *B66B 5/044* (2013.01)

(58) Field of Classification Search
USPC ..... 187/393
See application file for complete search history.

(56) References Cited

U.S. PATENT DOCUMENTS 6,196,355 B1 3/2001 Fargo et al.
8,172,042 B2 * 5/2012 Wesson ..... B66B 1/308 187/382
8,230,978 B2 * 7/2012 Agirman ..... B66B 5/027 187/290
8,789,659 B2 * 7/2014 Agirman ..... B66B 1/302 187/290
9,914,620 B2 * 3/2018 Rui ..... B66B 5/0031
10,273,116 B2 * 4/2019 Kattainen ..... B66B 1/32
10,662,028 B2 * 5/2020 Viita-Aho ..... B66B 5/027
2002/0162705 A1 * 11/2002 Shadkin ..... B66B 5/027 187/290
2008/0185233 A1 8/2008 Tegtmeier et al.
2009/0218175 A1 * 9/2009 Wesson ..... B66B 1/302 187/290
2010/0044160 A1 * 2/2010 Agirman ..... B66B 5/027 187/290
2011/0247900 A1 * 10/2011 Blasko ..... B66B 1/302 187/247
2012/0085593 A1 * 4/2012 Schoenauer ..... B66B 5/027 187/254
2012/0261217 A1 * 10/2012 Agirman ..... B66B 1/302 187/290
2014/0209415 A1 * 7/2014 Hall ..... H02J 9/062 187/290
2015/0053508 A1 * 2/2015 Kattainen ..... B66B 13/22 187/289
2015/0075917 A1 * 3/2015 Kattainen ..... B66B 1/308 187/288
2015/0222207 A1 * 8/2015 Matsushita ..... B66F 9/02 318/376
2016/0280507 A1 * 9/2016 Kattainen ..... B66B 5/027
2017/0050821 A1 2/2017 Viita-Aho et al.
2017/0279397 A1 * 9/2017 Marks ..... H02S 10/20
2018/0312370 A1 * 11/2018 Saarelainen ..... B66B 1/32
2018/0334359 A1 * 11/2018 Nikander ..... B66B 5/044
2019/0210838 A1 * 7/2019 Studer ..... B66B 1/3446
2020/0325000 A1 * 10/2020 Nakari ..... B66B 5/028
2020/0346890 A1 * 11/2020 Michaelidis ..... H04B 17/23
2020/0361745 A1 * 11/2020 Pahlke ..... B66B 5/0025

* cited by examiner

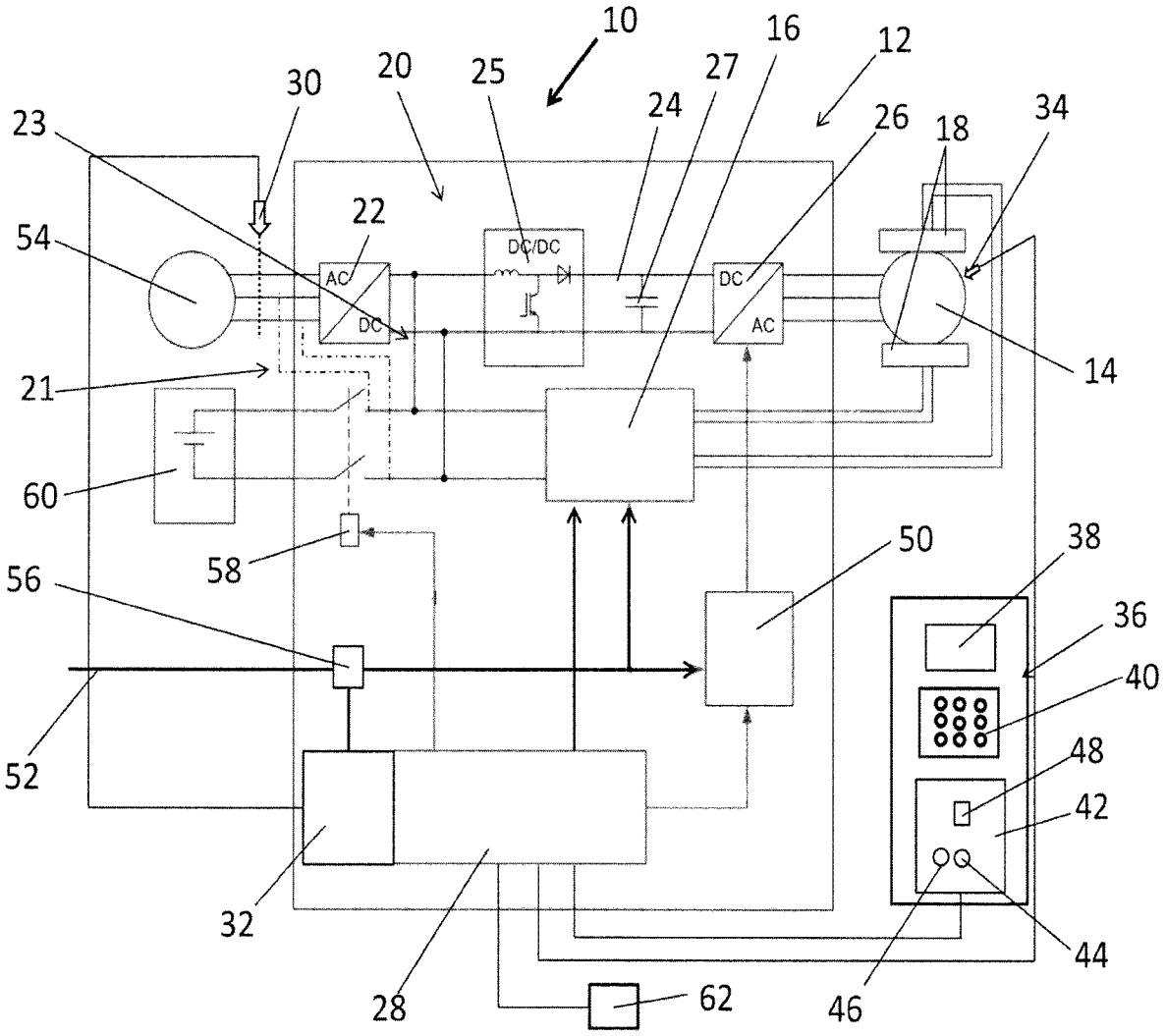
10
12
16
20
25
27
24
26
18
34
30
23
22
54
AC
DC
DC/DC
DC
AC
14
21
60
58
50
38
56
36
40
52
48
42
32
44
28
62
46

METHOD FOR PERFORMING A MANUAL DRIVE IN AN ELEVATOR AFTER MAINS POWER-OFF

In elevators situations appear, where the elevator car has been manually driven to a next landing, in most cases to release trapped passengers, but also for maintenance purposes. In conventional elevators a manual actuator, e.g. a release lever or push button is actuated to allow the elevator to move to the next floor level. For example in case of a mains power failure the elevator car may have stopped between floors and an automatic rescue operation—if provided—may have failed; In this case the service technician needs to move elevator car without mains power supply.

Most elevators nowadays have elevator motors driven via frequency converters having an inverter bridge supplying the different motor windings with current. In this case sometimes dynamic braking is applied to restrict the velocity of the elevator car during the manual drive. During this dynamic braking, which is produced when an e.g. permanent-magnet synchronous motor (PMSM) rotates with motor terminals short-circuited by the semiconductor switches of the inverter bridge. The braking torque achieved with dynamic braking is however limited to motor-specific maximum values which is less than the maximum torque, the motor could produce if it was supplied from frequency converter in normal operation. When motor rotates, it produces a torque which is limited to a maximum value and which begins to decrease as the motor speed increases beyond a maximum torque point. Thus, PMSM motors have to be over-dimensioned in some sense so that maximum dynamic braking torque will be enough for the particular elevator. Further, an asynchronous motor is unable to produce torque without external power for magnetizing the motor.

In some refined embodiments, instead of a manual brake lever, a manual electrical opening of the brakes is used. This is done by feeding current to the elevator brake from a battery by pushing a manual button to close the electricity supply device from battery to the brake coils of the elevator brake.

Instead of a manual rescue operation of the above type also an automatic rescue operation is known. Here the elevator control system automatically determines a rescue drive need and starts rescue drive to drive elevator car to the closest floor level. The benefit is that serviceman visit is not required to the elevator site. However this implementation may be more expensive, for example because of excessive battery capacity. On the other hand in some situations automatic rescue operation may not be possible, if visual inspection of elevator is needed, for example for safety reasons.

The object of the present invention is to allow a safe manual drive of the elevator car after mains power off to a nearby landing of the elevator.

The object is solved with a method according to claim 1 and with an elevator according to claim 12. Preferred embodiments of the invention are subject-matter of the dependent claims. Preferred embodiments of the invention are also described in the specification as well as in the drawings.

The method of the present invention for performing a manual drive in an elevator after mains power-off is to be performed in an elevator, which comprises an AC elevator motor a motor having a frequency converter, whereby the frequency converter comprises a rectifier bridge and an inverter bridge with semiconductor switches, which rectifier bridge and inverter bridge are connected via a DC link, and whereby the motor drive comprises a drive control at least to control the semiconductor switches of the inverter bridge to regulate the speed of the elevator motor to a reference speed, an elevator brake located in connection with the elevator motor and/or with a traction sheave of the motor, at least one elevator car running in an elevator driveway, at least two landing floors connected with the elevator driveway, at least one speed sensor for the motor speed and/or car speed, a manual emergency drive device connected to the drive control and comprising a manual drive control, a back-up battery and a manual operating interface with at least one actuator as well as a floor level indicator, which manual operating interface is disposed in a control panel of the elevator, in which method upon actuating the actuator following steps are carried out, preferably in the following succession:

a) the frequency converter of the motor is separated from mains, b) any safety blocking of the brake drive and/or motor drive is disabled c) current is supplied from the battery to the brake coils to open the elevator brake and current is supplied from the battery to the motor drive to allow regulation of the motor speed via the inverter bridge, d) the manual drive control observes the motor speed via the speed sensor and starts a speed feedback loop to regulate the motor speed to a manual drive reference value by feeding a three phase-AC current to the motor windings via the semiconductors of the inverter bridge, which speed reference is lower than the speed reference for normal operation, which speed regulation may be performed only in case the motor speed reaches or exceeds the manual drive reference value, e) when the car reaches a floor level the floor level indicator is activated, and f) the actuator is released whereafter the current supply from the battery to the elevator brake is interrupted and the previous disabled safety blocking of the brake drive and/or motor drive is enabled again.

According to the present invention, the manual emergency drive device is able to separate the frequency converter of the motor drive from mains and to connect the elevator brake and the motor drive with a battery so that generally the brakes may be opened during the emergency drive and so that the motor drive and its drive control are able to allow the motor to rotate as to drive the elevator car in the driveway, e.g. the elevator shaft, to a nearby landing. This means that first brakes are opened such that car starts to move due to gravity, because of unbalance of the car. Then movement is braked with motor, e.g. elevator drive is regenerating, such that no power is taken from battery to motor windings, but battery power is only required for supply voltage of control electronics (to supply drive control 28/manual drive control 32 microprocessors) to modulate high-side and low-side transistors of inverter bridge. This means that only very small battery is required. Power is required from battery to motor windings only if motor does not start to rotate when brakes are opened. This however means that motor is in balance condition, which then means that motor can be rotated with much smaller current anyway.

According to the invention, the manual emergency drive device uses the control abilities of the drive control an inverter bridge to control the semiconductor switches of the inverter bridge to brake the rotation of the motor caused by gravity. At the same time the motor speed is regulated by a speed feedback loop to a manual drive reference speed which is lower than the normal reference speed, used in normal elevator operation. The use of a lower manual drive reference speed gives a better control of the whole manual drive, particularly considering any safety related stops of the elevator car, which—in contrast to normal operation—regularly take place without any deceleration ramp before the stop.

Thus, in contrast to the prior art technology, where during an elevator emergency drive only dynamic braking has been used whereby the windings of the motor are short-circuited via the inverter bridge, now a real drive impulse is fed to the elevator motor via the inverter bridge so as to rotate the motor with a desired velocity according to the manual drive reference speed value. The advantage of this solution is that the elevator car can be driven in any load conditions with the desired velocity to the next landing in riding direction of the elevator car. Normally, the elevator motor is rotated by the imbalance between the gravitational force acting on the elevator car and the counterweight. Anyway, in circumstances where the weight of the elevator car including its load is about the same as the weight of the counterweight, there might be no movement at all. In the present invention, the use of the motor drive to rotate the motor with a desired velocity has the advantage that independent of the load conditions, the elevator car is always driven with a predefined speed according to the manual drive speed reference value of the manual drive device. The driving of the elevator motor with said predefined velocity reliably avoids any overspeed situation which could lead to the activation of the gripping device of the elevator car which is difficult to reset.

When the elevator car reaches a floor or landing level in step e), the floor level indicator is activated and a manual or automatic stop of the current supply to the brake and motor drive is performed either by releasing the actuator, which is regularly a push-button, or automatically by the manual drive control. Additionally, the blocking, overwriting or bypassing of safety signals of any safety devices which block signals from the motor drive or brake drive may now be terminated so that any further movement of the elevator motor and thus of the elevator car is stopped.

The stopping can happen by manually releasing the actuator which stops the feeding of pulses to the elevator motor with drive control signals and additionally stops feeding current to the elevator brake (coils).

The stop can also happen automatically by an internal relay of the manual emergency drive device which automatically releases the actuator and/or sets the elevator back from the emergency drive mode into normal mode, enabling safety signals blocking the brake drive and motor drive and cutting the connection between the battery on one hand and the elevator brake and the motor drive on the other hand.

When the elevator car has reached a floor zone, accordingly the current to the brake drive and to the motor drive is separated leading to the immediate stop of the elevator car. As in the emergency drive, the elevator car runs preferably with a lower velocity than the nominal velocity the immediate stop of the elevator car from the emergency drive does not lead to an excessive deceleration value when stopping. Preferably, the speed reference of the emergency drive is at most half of the nominal velocity of the elevator car.

Thus, the invention suggest a manual drive operation, e.g. for releasing trapped passengers or for maintenance purposes with active dynamic control. In active dynamic control the stator coils are not continuously short-circuited—as in dynamic braking—but they are modulated by igbt transistors of the inverter bridge as to rotate the rotor of the elevator motor with a predefined speed which is given by the manual drive speed reference, which is preferably lower than the speed reference for the nominal elevator speed during normal operation.

The active dynamic braking of this invention differs from traditional (passive) dynamic braking such that igbt transistors of motor bridge are modulated to produce a rotating field to brake the motor, instead of the traditional way to continuously short the stator winding wires together with separate switching element, such as dynamic braking contactor. In traditional case, when stator wires are shorted together, the motor torque has a maximum limit at specific speed, and torque begins to decrease when the speed increases beyond the maximum torque point, causing a race of the motor. So first the torque increases when rotating speed increases from zero, but after maximum torque point torque starts to decrease. The short device torque curve as well as the maximum torque point of permanent magnet motor depends on motor-specific parameters (inductance, resistance, electromotive voltage etc.). With some combinations, and with a large elevator unbalance, the motor torque produced by short-circuiting its windings is not sufficient to limit the motor speed before the maximum torque point. In other words, the motor speed in these cases cannot be limited with traditional passive dynamic braking. As a consequence, when speed raises over the maximum torque point, the torque decreases, having the effect that motor suddenly races causing triggering of the safety gear by overspeed governor, with the result that elevator car is gripped against guide rail. It is hassle some to release an elevator car where the gripping device has gripped. After the gripping, to get the passengers out of the car, first a separate hoist, such as Tirak, must be brought to elevator site to lift the car with a high force against the wedging force of the gripping device from the safety gear.

In the active dynamic braking of this invention, on the other hand, it is possible to obtain maximum motor torque at all speeds, because phase angle between motor current and voltage can be freely adjusted. In other words, the inventive active dynamic braking works with all possible motor/load combinations. There is no need to over-dimension the motor to get adequate short device torque.

Further, this operation is implemented under affecting the safety status of the brake drive and motor drive. Thus the invention uses a safety activation circuit which counteracts to the obligatory safety devices of the elevator for blocking elevator operation after a power-off. The safety devices comprise nowadays an electronic safety logic which operates such that when elevator drive is not allowed or possible (e.g. after a mains power-off), a +24V safety signal pending continuously during normal operation of the elevator is cut causing the safety logic to block control pulses of at least igbt transistors of motor bridge (so called STO logic) and brake controller of hoisting machinery brakes (SBC logic). Control pulses to motor bridge and brake controller transistors are only possible when the +24V safety signal is inputted to STO and SBC logics. The safety activation circuit enables the brake drive and the motor drive to work. On this behalf either safety signal may be altered or cut. Thus in a preferred embodiment of the invention the safety activation circuit connects the battery is connected with the safety line, e.g. via a logical OR member to provide the +24V safety signal for STO and SBC logics. This battery-provided +24V safety signal can be connected or disconnected via the safety activation circuit automatically or in connection with any manual operation of actuators or mode select switches located in the manual operating interface. Thus STO and SBC function may be bypassed from the manual operating interface. (Normally the +24V safety signal comes from elevator safety device, and it would otherwise prevent the active dynamic braking in manual rescue operation)

The inventive manual operating interface may have a push button as actuator. The manual operating interface may be disposed in an elevator control panel, for example in a landing door frame or in machine room. The battery can be disposed in the control panel or it can (preferably) be disposed in elevator shaft close to elevator drive and elevator motor. When the push button in the manual operating interface is pushed, electricity is supplied from battery to brake coils of hoisting machine to open the hoisting machinery brakes. The battery also provides supply voltage via the safety activation circuit to control electronics (e.g. DSP processor) of the motor bridge.

An example of the inventive manual drive operation, for example to release trapped passengers, works as follows:

- the frequency converter of the motor drive is separated from mains (with a manual mains switch or a separate mains relay, installed between the mains and the frequency converter, with the rectifier bridge of the frequency converter etc.)
- STO and SBC safety functions are bypassed from the manual operating interface (by a serviceman), by pushing a button. This means that operation of motor bridge igbt transistors as well as brake controller is enabled.
- the brake is opened from the manual operating interface (by a serviceman), and motor starts to move,
- the motor bridge controller observes motor speed. When motor speed reaches a given value (0.3 m/s), motor bridge controller starts speed control loop and regulates motor speed by braking the motor. The control principle is normal elevator motor speed control, which is a vector control with speed control and motor current control loops. Full control over motor torque is achieved.
- when the serviceman releases the manual operation interface button, current supply to brakes is interrupted and bypassing of STO and SBC functions is removed immediately.
- there are preferably at least two manual control buttons, a mode select switch that must first be turned to rescue operation mode and a manual push button, which must be continuously pushed (by the serviceman) to move the car.

This invention in summary uses drive frequency converter to control current phase angle with respect to motor source voltage/back-emf voltage allowing motor to produce torque as it would be possible in normal run.

The invention provides the following advantages:

- PMSM motor (permanent magnet synchronous motor) can be cheaper as there is no need to base motor design on maximum passive dynamic braking torque capability.
- The invention allows the active dynamic braking function to be used with asynchronous motors.
- There will always be enough torque to decelerate elevator to a desired speed during active dynamic braking.
- The risk of overspeed of the elevator car with manual brake opening is reduced.

In a preferred embodiment of the invention, after step a), the safety functions of the elevator car are bypassed to enable operation of the inverter bridge and of the elevator brake, and in step f), said bypassing of the safety devices is stopped. Usually, there is a safety device in the elevator which issues a signal to the motor drive as well as to the brake drive causing these drives to block any issue of control signals to the elevator brake or to the inverter bridge. The bypassing of the safety devices is possible if the corresponding safety line is linked with an output of the manual emergency drive device which continues feeding the enabling signals in case the enabling signals are stopped based on the power off of the elevator and the corresponding signals from the safety device. Thus, the normal enabled signal is a 24 V signal which is shut off when the mains goes down. The bypassing can happen if in case of interrupting the 24 V signal, this signal is fed by the manual emergency drive device, for example via a logical or element. Instead of bypassing other alternatives may be possible to manipulate safety devices as to enable the function of the brake drive and motor drive.

In this connection it should be carried out that the manual drive control may be a separate component in the elevator control or it may be integrated with the drive control, whereby particularly all functions of the manual drive control may be performed by the drive control of the motor drive. It is essential that the manual emergency drive device allows the environment of the motor drive and a brake drive as to work proper as in a normal operating condition so that also a speed signal of the elevator car and/or of the elevator motor, e.g. a tachometer of the elevator motor, is connected to the motor drive or the manual emergency drive to enable a feedback regulation loop for the motor speed.

The bypassing of the safety devices is possible automatically when the actuator is operated or when the elevator is turned into emergency drive mode, for example via a certain operating device, for example a mode select switch in the control panel of the elevator, for example in a manual operating interface which may be integrated in the elevator control panel. Thus, in a preferred embodiment, additionally to the actuator a mode select switch is provided which must be first operated to set the elevator to a manual rescue operation mode allowing the steps a) to f) to be performed afterwards by pushing or operating the actuator of the manual emergency drive device. This may be advantageous because when first setting the elevator to the rescue operation mode the safety devices blocking the motor drive or brake drive are bypassed and thus it can be seen if the bypassing of the safety devices and the energizing of the brake drive and the motor drive might result in any unexpected movement of the elevator car in which case the mode select switch might instantly switched back to normal mode.

Preferably, the actuator must be continuously pushed to allow steps a) to e), particularly step c) to be performed whereby any release of the actuator immediately leads to step f). This measure enhances the safety of the elevator as the operator has to manually push the actuator during the complete manual ride which enables him to immediately release the actuator if something unexpected should happen.

Preferably, the separating of the frequency converter of the motor drive from mains may be performed with a manual mode select switch or preferably with a separate main relay which is installed between mains and the frequency converter and which is preferably automatically disconnecting when the actuator is operated.

In a preferred embodiment of the invention, the reference value in step d) is chosen to keep the car speed to 0.3 m/s at the maximum. This slow riding velocity for the manual drive is large enough to bring the elevator car safely to the next landing level and is on the other hand slow enough so that any immediate stop from this velocity would not lead to an excessive deceleration value so that the comfort of the rescue drive is enhanced.

Preferably, step f) is performed automatically when the floor level indicator signals the reaching of the floor level by the elevator car. In this case, the operator releasing the passengers must not be so attentive to the actual level of the elevator car in the shaft as this level is controlled automatically and the elevator car is automatically stopped when the elevator car has reached the appropriate level to release the passengers to the landing.

Preferably, control principle of the speed regulation in step d) is a vector control with speed control and motor current control loops which is a very reliable and proven method to control the motor speed to the desired reference value.

In a preferred embodiment of the invention, the manual operating interface comprises a mode select switch, which sets the elevator in an emergency drive mode in which steps a) to b) are performed and in which safety devices which block the brake drive and/or motor drive from issuing control impulses are bypassed automatically or upon interaction with a manual switch located in the manual operating interface or in the elevator control panel. This is a two-step method wherein first the elevator has to be set into the manual emergency drive mode so as to bypass any signal devices and to connect the brake drive and the motor drive with the battery enabling them to generally issue control impulses to the respective components. Only afterwards, when operating the actuator, for example pushing a push button, the steps c) to f) may happen whereby the elevator car is really moved by the corresponding control signals of the semiconductors of the inverter bridge of the frequency converter.

The invention also relates to an elevator with following features:

an AC elevator motor a motor drive to regulate the speed of the elevator motor with a frequency converter, whereby the frequency converter of the motor drive comprises a rectifier bridge and an inverter bridge with semiconductor switches, which rectifier bridge and inverter bridge are connected via a DC link, and whereby the motor drive comprises a drive control at least to control the semiconductor switches of the inverter bridge to regulate the elevator motor to a reference speed, an elevator brake located in connection with the elevator motor and/or with a traction sheave of the motor, at least one elevator car running in an elevator driveway, at least two landing floors connected with the elevator driveway, at least one speed sensor for the motor speed and/or car speed, a manual emergency drive device comprising a back-up battery and a manual operating interface with at least one actuator as well as a floor level indicator, which manual operating interface is disposed in a control panel of the elevator, a switch or relay to separate the frequency converter of the motor from mains, the manual emergency drive device is connected to a connecting relay which is provided to connect the battery with the elevator brake and with the DC link of the motor drive and with the drive control to allow regulation of the motor speed via the inverter bridge, the manual emergency drive is connected to a safety activation circuit, enabling the brake drive and the motor drive to issue signals during the manual drive operation, which drive control is configured during the manual drive to obtain the motor speed via the speed sensor, and to start a speed feedback loop to regulate the motor speed to a reference value by feeding a three phase-AC current to the motor windings via the semiconductors of the inverter bridge.

With respect to the advantages and effects of the features of this inventive elevator it is referred to the above description of the inventive method. In this connection it is to be emphasized that the features of the elevator and of the method can be combined with each other arbitrarily.

In a preferred embodiment of this elevator, the manual emergency drive device is configured to disconnect the battery from the elevator brake and/or from the motor drive and drive control automatically when the floor level indicator is activated. This facilitates the release action of the operator as the elevator automatically stops when it reaches the floor level.

Preferably, the actuator is a push button which is a well-known actuator for emergency drive actions.

Preferably, the control panel is located in a landing door frame. This has the advantage that any movement of the elevator car might be monitored via a window in the control panel or via a camera and a display transmitting the movement of the elevator car to the display in the control panel. Furthermore, in this case, the manual operating interface can be located together with the elevator control panel in a space where normally a separating wall is located so that the arrangement of the control panel and the manual operating interface does not necessitate further space in the building.

The interruption of the current supply from the battery to the elevator brake typically includes the interruption of current flow to the brake drive, but also or alternatively may be realized by interrupting the current supply from the battery to the brake coils of the elevator brake by means of the brake drive, by controlling one or more brake drive switches.

Preferably, a DC converter is located in the DC link to boost the voltage level of the rectifier bridge and/or of the battery to a level suited for the inverter bridge to control the motor, whereby in this case the connection of the battery to the DC link is between the rectifier bridge and the DC converter.

Alternatively, the backup battery could be connected to AC side of the rectifier bridge, if the rectifier bridge is of the regenerating type including semiconductor switches then the battery could be connected to the AC side of the rectifier bridge as in this case the rectifier bridge is able to boost the voltage level from the battery level to a DC level sufficient for the inverter bridge to work. Of course, in this case the DC converter may be left away as no further boost of the voltage level is necessary.

A preferred embodiment of a typical manual rescue sequence is as follows, whereby in this case the manual emergency drive is integrated in the motor drive:

1) The motor drive has battery back-up power to keep electronics alive during blackout.
2) a building main supply blackout occurs and the motor drive is left without power stopping the elevator car between floors.
3) The motor drive detects that main supply is interrupted and opens a device which prevents supply voltage from entering the drive intermediate device if building power is restored.

4) The motor drive enters to deep a stand-by mode where a back-up battery energy consumption is minimized.
5) The service technician enters the site and turns a Manual Rescue Switch to switch the elevator to manual drive mode.
6) The motor drive detects that the manual drive mode has become active.
7) The motor drive requests back-up batteries to be connected to drive intermediate device using relays.
8) The motor drive requests back-up voltage to be generated for brake controller and motor bridge.
9) The drive's internal PFC, DC/DC, boost converter increases the intermediate device capacitor voltage from 48 volts to 300 volts allowing motor converter to produce enough voltage for driving the motor.
10) Another DC/DC converter start supplying 200 volts to the brake drive/controller.
11) A service technician activates safety voltage to drive which disables STO and SBC safety functions which, until now, have prevented the motor drive from controlling motor torque and opening elevator/machinery brakes.
12) The motor drive begins to produce such a voltage to motor that does not cause current and keeps speed controller disabled.
13) The motor drive opens elevator brakes.
14) The elevator speed begins to increase if there is unbalance in the elevator car vs. counterweight.
a. The motor drive activates motor speed controller when elevator speed has increased above some limit speed, for example, 0.30 m/s. Drive produces such current to motor that will cause motor to produce torque that will keep elevator speed at 0.30 m/s.
b. If elevator speed does not increase, the motor drive increases the speed by itself to 0.30 m/s if earlier parameter selections are enabling this kind of behaviour.
15) The elevator may stop at a next floor in driving direction if the manual operating interface detects a floor.
16) The elevator stops automatically when the floor level is reached or when the service technician stops pressing the push button (actuator).
17) After the service technician has switched Manual Rescue Switch to normal mode which turns all previously activated DC/DC converters off and disconnects back-up batteries from intermediate device. And then drive enters to deep stand-by mode again to conserve battery power.

The above-mentioned embodiments of the elevator and the method of the invention can be combined with each other arbitrarily. Also features from the elevator claims can be used in the method claims and vice versa.

Further, when the elevator car is stopped after having reached a landing level it is important to first disconnect the brake and afterwards the motor drive/drive control so that no free-fall situation can be established, which is per se known.

Following terms are used as a synonym: emergency drive—safety drive; actuator—push button; AC elevator motor—three-phase AC elevator motor; manual drive device—manual emergency drive device; manual rescue switch—mode select switch; manual operating interface—manual operating control; backup battery—battery;

The FIGURE is a schematic view of a part of the elevator involved in an emergency drive after mains power off.

The invention is described hereinafter via an example in connection with the appended drawing. This shows a part of an elevator which is involved in a manual emergency drive of the elevator after mains power off. The elevator 10 comprises a motor drive 12 driving an elevator motor 14 and a brake drive 16, actuating two elevator brakes 18. The motor drive 12 comprises a frequency converter 20 with a rectifier bridge 22, an intermediate DC link 24 and an inverter bridge 26 which is connected to the elevator motor 14. In the DC link 24 a DC converter 25 is located between the rectifier bridge 22 and the inverter bridge 26 to boost the DC voltage to a level high enough for the inverter bridge 26 to work. On the high level side of the DC converter 25 an optional smoothing capacitor 27 is connected to reduce any voltage ripple in the DC link 24 at the input of the inverter bridge 26. At least the inverter bridge 26 of the frequency converter 20 is controlled by a drive control 28. The motor drive 12 further comprises a mains relay 30 which can be activated via a manual drive control 32 of the manual emergency drive which is connected to the drive control 28 or integrated with it. A tachometer 34 sensing the rotational speed of the elevator motor 14 is connected to the drive control 28. Furthermore, the drive control 28 is connected with a control panel 36 of the elevator 10 comprising a display 38, an operating panel 40 as well as a manual operating interface 42 comprising an actuator 44 preferably embodied as a push button, a manual rescue switch 46 as well as floor level indicator 48 indicating when the elevator car has reached a floor level of the elevator. The signals from the drive control 28 to the inverter bridge 26 are guided over a pulse blocking device 50 which is triggered by a safety signal line 52 for example from a safety device (safety module with safety chain) of the elevator 10. In normal operation, this signal line 52 is for example on +24 V level allowing the brake drive 16 and the drive control 28 to issue their control commands to the respective components 18, 26. In case of power off of AC mains 54, this signal on the safety signal line 52 drops to 0 V whereafter the drive control 28 and the brake drive 16 cannot issue any control pulses. In the safety signal line 52, an OR member 56 is located which is connected to an output of the manual drive control 32. Furthermore, a connecting relay 58 is provided to connect a backup battery 60 via connection (or connection lines) 23 to the DC link 24 of the frequency converter and thus also to the drive control 28 as well as to the brake drive 16.

Alternatively, instead of the connecting lines 23 the backup battery 60 could be connected to the frequency converter 20 via the AC side of the rectifier bridge 22, with the dotted alternative connection lines 21. This is possible if the rectified bridge 22 is of the regenerating type, including AC side inductors. This kind of rectified bridge 22 is capable of boosting the battery voltage to a higher DC link voltage sufficient for the inverter bridge 26 to work. In this case a DC converter 25 is necessarily needed in DC link 24.

The operation of an emergency drive is as follows:

After power off of AC mains 54, the elevator 10 automatically sets the voltage on the safety signal line 52 to zero disabling the issuing of control pulses of the drive control 28 and brake drive 16. In this case, the operator opens a cover door of the elevator control panel 36 and pushes the manual rescue switch 46 to manual drive mode. This activates mains relay 30 as to separate the frequency converter 20 from AC mains 54. Furthermore, the manual drive control 32 issues a 24 V signal to the OR member 56 so that the pulse blocking device 50 and safety device in the brake drive 16 is deactivated so that the brake drive 16 and the drive control 28 can issue control signals to their respective components. Now the actuator (manual drive push button) 44 is pushed which leads to the activation of the connecting relay 58 as to connect the backup battery 60 with the brake drive 16 as well as with the DC link 24 of the frequency converter 20 of the motor drive 12. First, brake drive 16 supplied current to electromagnets of the brakes 18 to open the brakes. The drive control 28 observes the motor speed via the tachometer 34 and the drive control 28 starts a feedback loop to regulate the motor speed to a manual drive reference value by feeding a three-phase AC current to the elevator motor via the semiconductors of the inverter bridge 26. This means that the elevator motor 14 is actively driven (active dynamic braking) by the inverter bridge as to rotate with a given manual drive speed reference which is lower than the nominal velocity of the elevator motor when driving the elevator car with nominal velocity. The manual drive speed reference for the elevator motor can for example be chosen so that the speed of the elevator car does not exceed a value of for example 0.3 m/s. When the car reaches a floor level which is sensed by the motor drive via a floor level sensor 62, the floor level indicator 48 is activated and either the manual drive control 32 automatically stops the elevator motor 14 for example by disabling the action of the actuator 44 or by overriding the action of the actuator by an own switching mechanism with which the current supply from the battery to the elevator brake is interrupted and preferably also the current supply to the motor drive is interrupted, for example by operating the connecting relay 58 as to separate the backup battery 60. Another possibility is that the actuator is released manually by the operator when he sees the floor level indicator lighting up so that the stopping of the elevator car is done manually by the operator. In both cases, the elevator is driven to the next landing door with a given manual drive reference velocity provided for an emergency drive which is lower than the nominal velocity.

In some embodiments it is also possible that against the force conditions of the imbalance between car and counterweight, the car is operated in counter-direction to its normal moving direction due to gravitational force. Thus, it is possible to drive the elevator car to special landings which are intended for these emergency drives and for example to avoid certain landings as for example the top level or the base level. This of course requires that battery capacity is dimensioned adequately.

In the above embodiment, there is a separate manual rescue switch and a separate actuator. Of course, there might only be the actuator so that the elevator automatically goes into the manual emergency drive mode when the actuator is pressed. Furthermore, for the bypassing of safety devices, a further push button may be located in the manual operating interface.

When after the emergency drive the elevator is stopped and the battery is disconnected, preferably also the bypassing of the safety devices is stopped so that the signal on the safety signal line is 0 V again which disables the brake drive 16 and the drive control 28 from issuing any control signals to the respective components 26, 18.

The invention is not restricted to the above-mentioned embodiment but may be varied within the scope of the appended patent claims.

LIST OF REFERENCE NUMBERS

10 elevator
12 motor drive
14 elevator motor
16 brake drive
18 elevator brakes
20 frequency converter
21 alternative connection of the battery to the AC side of the rectifier bridge of the frequency converter, in case of a rectifier bridge of the regenerating type
22 rectifier bridge
23 connection of the battery to the DC link in one embodiment of the invention
24 DC link
25 DC converter
26 inverter bridge with semiconductor switches (e.g. MOSFETs or IGBTs)
27 smoothing capacitor
28 drive control
30 mains relay
32 manual drive control
34 tachometer
36 elevator control panel
38 window or display
40 operating panel
42 manual operating interface
44 actuator
46 manual rescue switch
48 floor level indicator
50 pulse blocking device
52 safety signal line
54 AC mains
56 logical OR member
58 connecting relay
60 backup battery
62 floor level sensor

The invention claimed is:

1. A method for performing a manual drive in an elevator after mains power-off, the elevator comprising:

an AC elevator motor;

a motor drive having a frequency converter, whereby the frequency converter comprises a rectifier bridge and an inverter bridge with semiconductor switches, rectifier bridge and the inverter bridge being connected via a DC link, and whereby the motor drive comprises a drive control at least to control the semiconductor switches of the inverter bridge to regulate the speed of the elevator motor to a reference speed;

at least one elevator brake located in connection with the elevator motor and/or with a traction sheave of the motor;

at least one elevator car running in an elevator driveway;

at least two landing floors connected with the elevator driveway;

at least one speed sensor for the motor speed and/or car speed; and a manual emergency drive connected to the drive control and comprising a manual drive control, a back-up battery and a manual operating interface with at least one actuator as well as a floor level indicator, the manual operating interface being disposed in a control panel of the elevator, in which method, upon actuating the actuator, the following steps are carried out:

a) separating the frequency converter of the motor from mains;

b) disabling any safety blocking of the brake drive and/or motor drive;

c) supplying current from the battery to the brake drive to open the elevator brake and supplying current from the battery to the drive control to allow regulation of the motor speed via the inverter bridge;

d) the manual drive control observing the motor speed via the speed sensor and starting a speed feedback loop to regulate the motor speed to a manual drive reference value by feeding a three phase-AC current to the motor windings via the semiconductors of the inverter bridge, the manual drive speed reference being lower than the speed reference for normal elevator operation;

e) when the car reaches a floor level activating the floor level indicator; and f) releasing the actuator, whereafter interrupting the current supply from the battery to the elevator brake and enabling the previous disabled safety blocking of the brake drive and/or motor drive again.

2. The method according to claim 1, wherein in step e) the current supply from the battery to the motor drive is interrupted after the current supply from the battery to the elevator brake is interrupted.

3. The method according to claim 2, wherein in step b) the at least one safety signal of any safety devices of the elevator is bypassed or altered to enable operation of the inverter bridge and of the elevator brake, and in step f) said bypassing is stopped.

4. The method according to claim 2, wherein additionally to the actuator a mode select switch is provided which must first be turned to set the elevator to a rescue operation mode allowing steps a) to f).

5. The method according to claim 1, wherein in step b) the at least one safety signal of any safety devices of the elevator is bypassed or altered to enable operation of the inverter bridge and of the elevator brake, and in step f) said bypassing is stopped.

6. The method, according to claim 5, wherein the safety functions are bypassed manually via the actuator or via a different operating element located in the manual operating interface.

7. The method according to claim 1, wherein additionally to the actuator a mode select switch is provided which must first be turned to set the elevator to a rescue operation mode allowing steps a) to f).

8. The method according to claim 1, wherein the actuator must be continuously pushed to allow steps a) to f) or c) to f) to be performed, whereby any release of the actuator immediately leads to step f).

9. The method according to claim 1, wherein in step a) the frequency converter of the motor drive is separated from mains with a manual main switch or via a separate main relay, installed between the mains and the rectifier bridge of the frequency converter.

10. The method according to claim 1, wherein the manual drive reference value in step d) is chosen to keep the car speed to 0.3 m/s at the maximum.

11. The method according to claim 1, wherein step f) is performed automatically when step e) happens to take place.

12. The method according to claim 1, wherein the control principle of the speed regulation in step d) is a vector control with speed control and motor current control loops.

13. The method according to claim 1, wherein the manual operating interface comprises a mode select switch, which sets the elevator in an emergency drive mode in which steps a), b) and eventually c) are performed.

14. An elevator comprising:

an AC elevator motor;

a motor drive to regulate the speed of the elevator motor with a frequency converter, whereby the frequency converter of the motor drive comprises a rectifier bridge and an inverter bridge with semiconductor switches, the rectifier bridge and the inverter bridge being connected via a DC link, and whereby the motor drive comprises a drive control at least to control the semiconductor switches of the inverter bridge to regulate the elevator motor to a reference speed;

an elevator brake located in connection with the elevator motor and/or with a traction sheave of the motor;

at least one elevator car running in an elevator driveway;

at least two landing floors connected with the elevator driveway;

at least one speed sensor for the motor speed and/or car speed;

a manual emergency drive comprising a manual drive control, a back-up battery and a manual operating interface with at least one actuator as well as a floor level indicator, the manual operating interface being disposed in a control panel of the elevator; and a switch or relay to separate the frequency converter of the motor from mains, wherein the manual drive control is connected to a connecting relay which is provided to connect the battery with the brake drive and with the DC link of the frequency converter and with the drive control to allow regulation of the motor speed via the inverter bridge, wherein the manual drive control is connected to a safety activation circuit, enabling the brake drive and the motor drive to issue signals during the manual drive operation, and the drive control is configured during the manual drive to obtain the motor speed via the speed sensor, and to start a speed feedback loop to regulate the motor speed to a manual drive reference value by feeding a three phase-AC current to the motor windings via the semiconductors of the inverter bridge, the manual drive speed reference being lower than the speed reference for normal elevator operation.

15. The elevator according to claim 14, wherein the manual drive control is configured to disconnect the battery from the elevator brake and/or from the motor drive and drive control when the floor level indicator is activated.

16. The elevator according to claim 14, wherein the actuator is a push button.

17. The elevator according to claim 14, wherein the control panel is located in a landing door frame.

18. The elevator according to claim 14, wherein the manual drive control is configured to bypass or alter a safety signal for the brake drive and drive control.

19. The elevator according to claim 14, wherein the manual operating interface comprises a mode switch, which initiates the manual emergency device to bypass safety signals safety devices which block the brake drive and/or motor drive from issuing control impulses.

20. The elevator according to claim 14, wherein a DC converter is connected in the DC link between the connection of the battery to the DC link and the inverter bridge or the connection of the battery to the frequency converter is connected to the AC side of the rectifier bridge and the rectifier bridge is of the regenerating type.

* * * * *